US009433243B1

(12) United States Patent
Blakeney

(10) Patent No.: US 9,433,243 B1
(45) Date of Patent: Sep. 6, 2016

(54) BABY BURPING CLOTH

(71) Applicant: Claudia H. M. Blakeney, Hamilton (CA)

(72) Inventor: Claudia H. M. Blakeney, Hamilton (CA)

( * ) Notice: Subject to any disclaimer, the term of this patent is extended or adjusted under 35 U.S.C. 154(b) by 745 days.

(21) Appl. No.: 13/747,796

(22) Filed: Jan. 23, 2013

(51) Int. Cl.
*A41B 13/00* (2006.01)

(52) U.S. Cl.
CPC ..... *A41B 13/00* (2013.01)

(58) Field of Classification Search
CPC ..... A41B 13/06; A41B 13/00; A41B 13/10; A41B 13/103; A41B 13/106; A41B 2400/32; A47D 13/025
See application file for complete search history.

(56) References Cited

U.S. PATENT DOCUMENTS 2,227,751 A * 1/1941 Idelman ..... A41B 13/06 2/114
3,481,517 A * 12/1969 Aukerman ..... A47D 13/025 224/160
4,009,808 A * 3/1977 Sharp ..... A47D 13/025 224/160
4,402,440 A * 9/1983 Purtzer ..... A47D 13/025 224/159
4,579,264 A * 4/1986 Napolitano ..... A47D 13/025 224/158
4,611,353 A * 9/1986 Als ..... A41B 13/06 2/69
4,897,885 A * 2/1990 Lunt ..... A41B 13/06 2/69.5
5,046,204 A * 9/1991 Mohler ..... A41B 13/06 2/69
5,611,095 A * 3/1997 Schneider ..... A41B 13/06 2/69
5,640,717 A * 6/1997 Ray ..... A41B 13/06 2/69
5,678,739 A * 10/1997 Darling ..... A47D 13/025 224/158
5,722,094 A * 3/1998 Ruefer ..... A41B 13/06 2/69
5,950,261 A * 9/1999 Hay ..... A41B 13/06 2/69
5,956,762 A 9/1999 Adams
6,009,576 A * 1/2000 Gramme ..... A41B 13/06 2/69
6,408,439 B1 * 6/2002 Garforth-Crippen ..... A41B 13/106 2/80
6,415,442 B1 * 7/2002 Smith ..... A41B 13/06 2/69.5
6,640,340 B2 * 11/2003 Gibson ..... A41B 13/06 2/69.5
6,666,361 B1 * 12/2003 Lin ..... A45F 3/02 224/160
D485,676 S * 1/2004 Simpson ..... D3/213
6,757,922 B2 * 7/2004 Chancey ..... A47G 9/066 2/69.5
6,763,983 B2 * 7/2004 Norman ..... A47D 13/025 224/160
6,817,033 B2 * 11/2004 Bailey ..... A41B 13/06 2/69.5
6,836,902 B2 * 1/2005 Marquez ..... A47D 13/046 2/69
7,082,617 B1 8/2006 Poindexter et al.
7,246,392 B2 * 7/2007 Schmid ..... A41B 13/06 2/69.5

(Continued)

*Primary Examiner* — Danny Worrell
(74) *Attorney, Agent, or Firm* — Robert C. Montgomery; Montgomery Patent and Design, LP.

(57) ABSTRACT

A baby burping cloth for burping by an infant as well as providing protection to a caregiver is disclosed. The baby burping cloth comprises a "cross"-shaped cloth assembly having a pair of openings for insertion of an infant's leg portions, a pair of side sections to wrap around the infant, a neck section to protect the caregiver, and an accessible inner space. The inner space is configured to retain a prosthetic breast which increases pressure upon the infant to burp.

11 Claims, 3 Drawing Sheets

(56) References Cited

U.S. PATENT DOCUMENTS

| | | | | |
|---|---|---|---|---|
| 7,574,750 | B2 * | 8/2009 | Harris | A41B 13/005 2/69.5 |
| 7,661,566 | B2 * | 2/2010 | Yoshie | A45F 4/02 224/158 |
| 7,681,261 | B1 * | 3/2010 | O'Neill | A41B 13/06 2/69.5 |
| 7,765,609 | B2 | 8/2010 | Chase | |
| D623,380 | S * | 9/2010 | Feguin de Wattville | D2/728 |
| 8,011,037 | B1 * | 9/2011 | Earnest | A41B 13/06 128/872 |
| D650,558 | S * | 12/2011 | Ruse-Petersen | D2/719 |
| D653,025 | S * | 1/2012 | Brown | D3/213 |
| 8,191,188 | B2 * | 6/2012 | Kaplan | A47D 15/008 2/69.5 |
| 8,302,225 | B1 * | 11/2012 | Earnest | A41B 13/06 5/413 R |
| D700,433 | S * | 3/2014 | Ammar | D2/719 |
| 8,783,530 | B1 * | 7/2014 | Jordan | A47D 13/025 224/158 |
| 9,032,572 | B1 * | 5/2015 | Leach | A47D 15/003 5/655 |
| 9,131,734 | B2 * | 9/2015 | Daugherty | A41B 13/06 |
| 2004/0019969 | A1 * | 2/2004 | Gatten | A41B 13/06 5/482 |
| 2005/0045674 | A1 * | 3/2005 | Rehbein | A47D 13/025 224/160 |
| 2005/0218168 | A1 * | 10/2005 | Chua | A47D 13/025 224/160 |
| 2007/0239123 | A1 | 10/2007 | Pressler | |
| 2008/0201815 | A1 | 8/2008 | Barclay | |
| 2008/0263740 | A1 | 10/2008 | Wright et al. | |
| 2009/0089910 | A1 | 4/2009 | Lopez | |
| 2012/0110716 | A1 * | 5/2012 | Christensen | A47G 9/083 2/69.5 |

* cited by examiner

BABY BURPING CLOTH

RELATED APPLICATIONS

There are no current co-pending applications.

FIELD OF THE INVENTION

The presently disclosed subject matter is directed toward infant care devices. More particularly the present invention is directed to a baby burping cloth for improving infant burping and protecting a caregiver.

BACKGROUND OF THE INVENTION

One (1) of the first things a parent or other caregiver finds out about a new infant is that an infant requires a lot of time, care and effort. Basic things such as feeding seem to take the most time and effort.

One (1) very big problem with feeding an infant is that as an infant feeds it swallows a great deal of air. That air must be released to prevent various problems such as spitting up, colic and gas. To remove the swallowed air an infant needs to be burped.

Burping can be performed in several different ways. However, probably the most common method is to have a parent (or other caregiver) sit upright while holding the infant against the parent's chest. The infant's chin is placed on the parent's shoulder while the infant is supported using one hand. The other hand is then used to gently pat and/or rub the infant's back. Parents quickly learn various modifications of this method that best suit the infant. Some infants like to be rocked, some bounced, some gently moved, others held still.

Burping an infant is highly effective at removing air. Unfortunately the traditional method of burping is not without problems. One (1) of the first problems, which is quickly learned, is that an infant not only burps air but some of its stomach content. This problem is usually addressed by using a burping rag placed under the infant's chin to catch the stomach content.

Another problem is more difficult to address: the infant is only held by one hand. Because the safety of an infant is paramount this can be a very large problem with infants that move a great deal. Yet another problem is that at times, because mothers more often burp infants, their infants become accustom to the feel of the mother's breast during burping. When the father tries to burp the infant the infant is not as comfortable and burping can become less effective.

Finally, simply holding an infant against the chest is less than optimal at inducing burping. Yet that position is almost always the most comfortable way to hold a baby using only one hand. Allowing an infant to kick its legs may be useful for some infants, but having to safely hold an infant tends to restrict leg movement.

Therefore, a device for addressing prior art problems with burping would be useful. More particularly, a baby burping cloth that catches an infant's stomach content and that can mimic the feel of a mother would be useful. Even more useful would be such a baby burping cloth that improves infant safety during burping. In particular, a baby burping cloth that enables an infant to be held safely while kicking its legs would be useful.

SUMMARY OF THE INVENTION

The principles of the present invention provide for a baby burping cloth that catches an infant's stomach content and that can mimic the feel of a mother. Such a baby burping cloth is also useful for improving infant safety during burping. One (1) benefit of the improved safety is having allowing an infant to kick its legs during burping.

A baby burping cloth that is in accord with the present invention includes a "cross"-shaped cloth assembly having a front panel and a rear panel that are attached along their edges. The cloth assembly includes a leg section having leg openings, a first side section, a second side section, and a shoulder section. In addition the cloth assembly includes at least a first fastener, preferably a hook-and-loop fastener, for holding the first side section and the second side overlapped. Additionally the baby burping cloth includes a strap for fastening the baby burping cloth to a user. In practice the front panel and the rear panel are substantially identical and are sown together. The leg openings pass through both the front and rear panels. A second fastener can be used to attach the leg section to an upper part of the cloth assembly.

An alternative baby burping cloth that is in accord with the present invention includes a "cross"-shaped cloth assembly having a front panel and a rear panel that are attached along their edges to define an inner space. The cloth assembly includes a shoulder section, a leg section having leg openings, a first side section, and a second side section. In addition, there is a first access opening into the inner space. The inner space has a front fastening surface that is accessible by the first access opening. A first fastener is attached to the cloth assembly for holding the first side section and the second side section in an overlapping configuration. The baby burping cloth also includes a strap for fastening the baby burping cloth to a user.

Beneficially the alternative baby burping cloth includes a prosthetic breast in the inner space. The prosthetic breast is accessible to a user by the first access opening and is attachable to a front fastening surface. Beneficially there is also a rear fastening surface within the inner space that is accessible by the first access opening and the prosthetic breast is also attachable to the rear fastening surface. In practice there may be a second access opening into the inner space which provides access to the front fastening surface, to the rear fastening surface, and to the prosthetic breast.

Preferably the alternative baby burping cloth is constructed such that the front panel and the rear panel are identical and are sewn together. Furthermore, leg openings pass through both the front and rear panels. The alternative baby burping cloth preferably uses a hook-and-loop fastener and includes a strap for fastening the baby burping cloth to a user.

A second alternative baby burping cloth that is in accord with the present invention includes a "cross"-shaped cloth assembly having a front panel and a rear panel that are attached along their edges so as to define an inner space having a front fastening surface and a rear fastening surface. The cloth assembly includes a shoulder section, a leg section having leg openings, a first side section, and a second side section. The second alternative baby burping cloth further includes a first access opening and a second access opening into the inner space, a plurality of fasteners attached to the cloth assembly for holding the first side section and the second side section in an overlapping configuration and for holding the bottom of said leg section in an upward folded configuration; and a strap for fastening the second alternative baby burping cloth to a user.

The second alternative baby burping cloth can further include a prosthetic breast having a surface that is configured to attach to either the front or rear fastening surfaces. That prosthetic breast is accessible by the first and second access openings.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
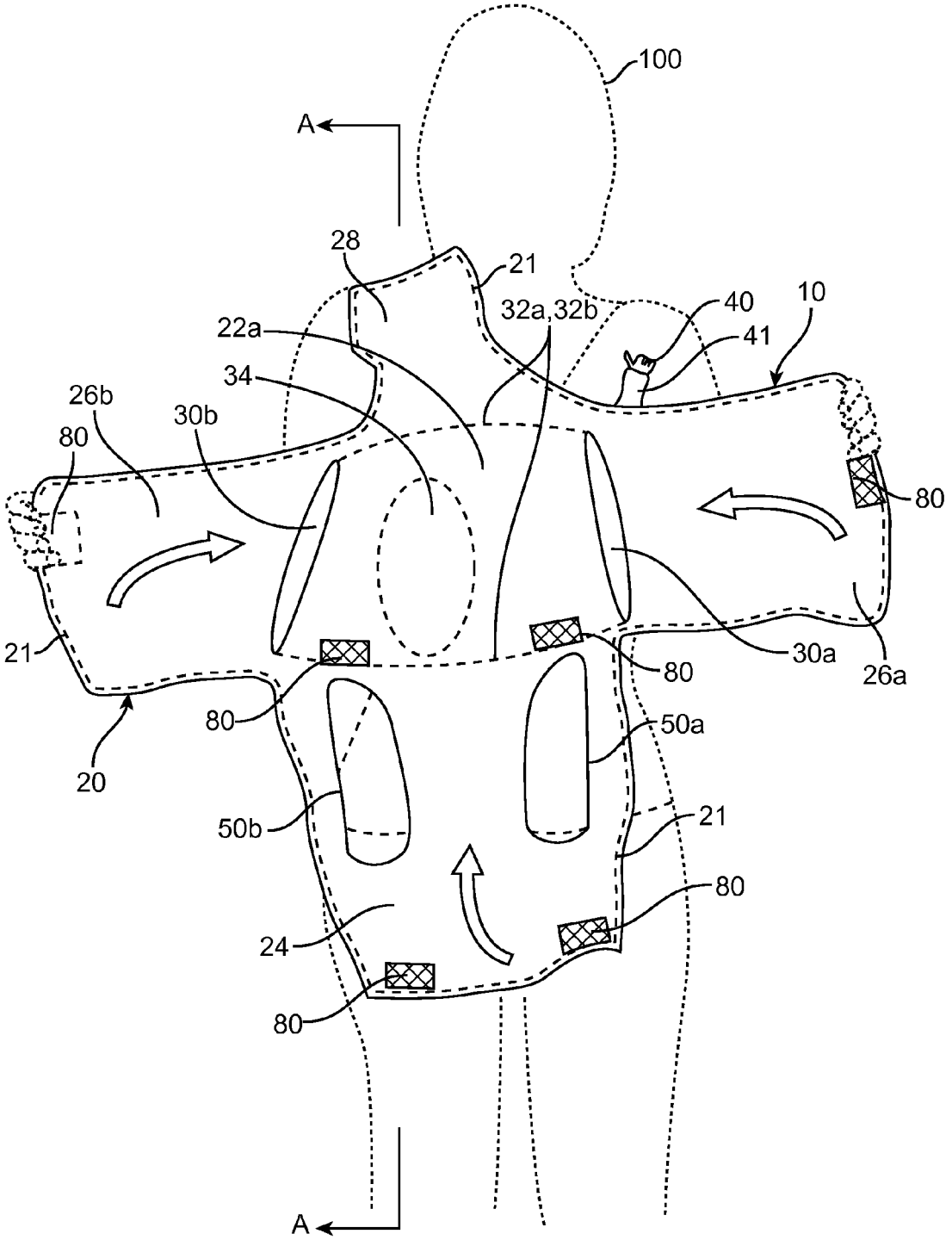
FIG. 1 is a front view of a baby burping cloth 10 that is in accord with a preferred embodiment of the present invention.

10 baby burping cloth
20 cloth assembly
21 edge seam
22*a* front panel
22*b* rear panel
24 leg section
26*a* first side section
26*b* second side section
28 shoulder section
30*a* first access opening
30*b* second access opening
31 inner space
32*a* front fastening surface
32*b* rear fastening surface
34 prosthetic breast
36 filler
38 breast fastening surface
40 clip
41 strap
50*a* first leg aperture
50*b* second leg aperture
80 fastener
100 caregiver
105 infant

DETAILED DESCRIPTION OF THE PREFERRED EMBODIMENT

Figure 2:
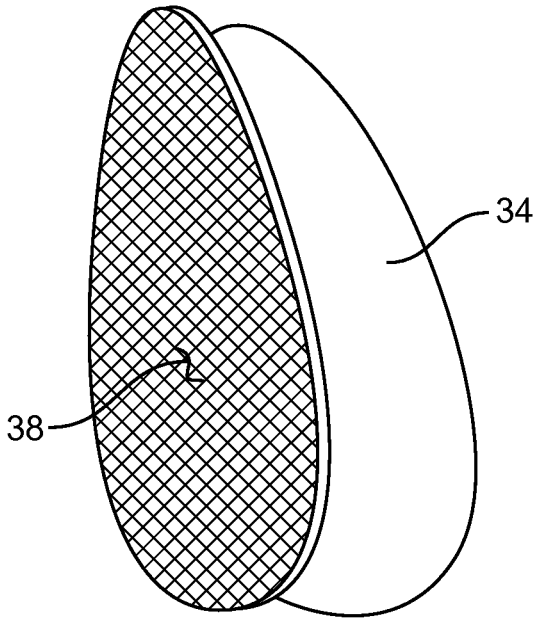
FIG. 2 is a perspective view of a prosthetic breast 34 used in the baby burping cloth 10 shown in FIG. 1; and, FIG. 3 is a section view of the baby burping cloth 10 taken along section line A-A of FIG. 1.
Figure 3:
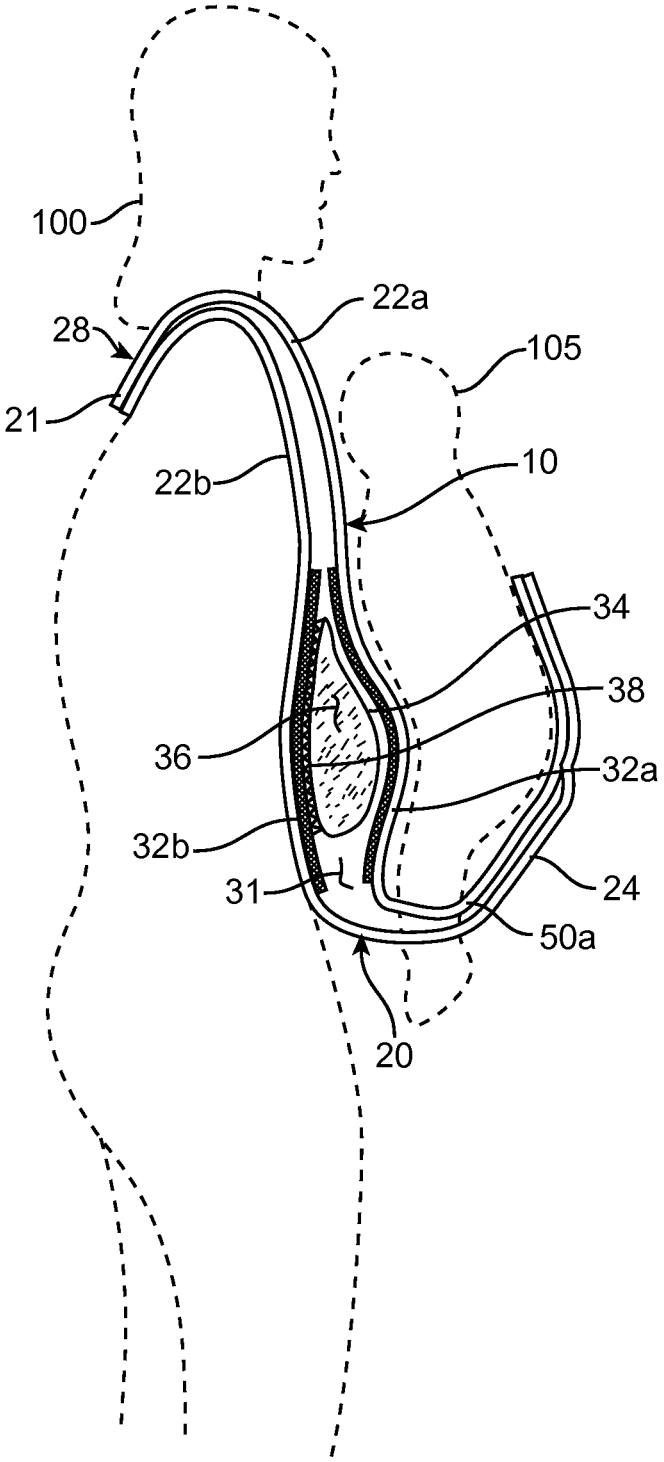

The best mode for carrying out the invention is presented in terms of its preferred embodiment, herein depicted within FIGS. 1 through 3. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a baby burping cloth 10 and its use. Referring to FIG. 3, the baby burping cloth 10 provides a two-layer cloth assembly 20 having both internal and external features for comfort and safety when burping an infant 105.

Refer now primarily to FIGS. 1 and 3, which respectively present front and section views of the baby burping cloth 10, which is in accord with a preferred embodiment of the present invention. As shown, the baby burping cloth 10 includes a "cross"-shaped cloth assembly 20. The cloth assembly 20 includes identically a front panel 22*a* and a rear panel 22*b* which are sown together along their perimeter via an edge seam 21 and which are identical or at least substantially the same. The cloth assembly 20 is envisioned as being available in a variety of attractive colors and patterns and made using the soft natural and synthetic fabrics common in baby blankets and infant clothing. Additionally, the baby burping cloth 10 is envisioned as being made available in a variety of sizes which correspond to the growth of an infant 105, such as "newborn", "infant", and "toddler" sizes.

Still referring to FIGS. 1 and 3, the cloth assembly 20 includes a leg section 24, a first side section 26*a*, a second side section 26*b*, and a shoulder section 28. The side sections 26*a*, 26*b* and leg section 24 are configured to wrap around and support an infant 105 in a desired fashion when fastened together (see FIG. 3 and the also reference the fastener description provided below). The shoulder section 28 is configured to lie on a caregiver and to protect them while burping. A newborn infant 105 may be partially enveloped within the cloth assembly 20 by pulling the leg section 24 upward and securing the leg section 24 around the infant 105 using fasteners 80 (FIG. 1). Subsequently the first section 26*a* and the second section 26*b* can then be sequentially wrapped sideways around the infant 105 and secured with additional fasteners 80. An older infant can be carried with their legs extending through leg openings 50*a* and 50*b*.

The leg section 24 of the cloth assembly 20 comprises a first leg aperture 50*a* and a second leg aperture 50*b* arranged side-by-side that extend through both the front panel 22*a* and the rear panel 22*b*. This enables an infant 105 to insert their legs through the leg apertures 50*a*, 50*b* to be supported. The fasteners 80 are preferably of the hook-and-loop type to enable easy, single handed use. This feature is very useful while supporting the infant 105.

Referring now to FIGS. 2 and 3, the cloth assembly 20 enables removable attachment of a prosthetic breast 34 within an inner space 31 of the cloth assembly 20. The prosthetic breast 34 is envisioned as being positioned against the torso of the infant 105. The prosthetic breast 34 is configured to be affixed to a large front fastening surface 32*a* which is permanently sewn to an inward facing surface of the front panel 22*a*. Likewise, the rear panel 22*b* has a large rear fastening surface 32*b* that is sewn to the opposing surface. This enables reversible attachment of the prosthetic breast 34. The front fastening surface 32*a* and the rear fastening surface 32*b* are envisioned as being approximately sixteen inches (16 in.) in width and approximately twelve inches (12 in.) in height.

Still referring to FIGS. 2 and 3, the prosthetic breast 34 comprises a corresponding breast fastening surface 38 which covers one (1) side of the prosthetic breast 34. That breast fastening surface 38 enables attachment of the prosthetic breast 34 to either the front fastening surface 32*a* or to the rear fastening surface 32*b*. The front fastening surface 32*a*, rear fastening surface 32*b*, and breast fastening surface 38 are envisioned as being comprise permanently sewn-in sheets of hook-and-loop fastener material to allow easy attachment and repositioning of the prosthetic breast 34.

The prosthetic breast 34 can be used to increase the pressure upon the infant 105 during burping. Referring now to FIGS. 1 and 3, to install the prosthetic breast 34 a caregiver 100 accesses the inner space 31 of the cloth assembly 20 through a pair of oval-shaped access openings 30*a*, 30*b* that are formed within the front panel 22*a*. The access openings 30*a*, 30*b* are positioned near armpits of the caregiver 100. This allows the caregiver 100 to selectively position the prosthetic breast 34 at a desired location either to the front 32*a* or rear 32*b* fastening surfaces. Thus the baby burping cloth 10 is fully reversible, side-to-side and front-to-back which enables the shoulder section 28 of the cloth assembly 20 to be draped over the right or left shoulder of the caregiver 100. The cloth assembly 20 also may be used without the prosthetic breast 34.

Referring now to FIG. 3, the prosthetic breast 34 comprises a bag-like structure that is envisioned to comprise a compliant and supple outer layer made from latex, rubber, or the like. The prosthetic breast 34 includes a filler 36 of small polystyrene beads or an equivalent material which emulates the texture of a human breast. It is envisioned that the prosthetic breast 34 be introduced in a variety of volumetric sizes to produce a desired burping effect as well as corresponding to the size of the infant 105.

As shown in FIG. 1, the baby burping cloth 10 further includes a clip 40 that is permanently affixed along a top edge of the cloth assembly 20. That clip enables attaching the baby burping cloth 10 to the clothing of the caregiver 100. The clip 40 is envisioned as being a common spring clamping device that is permanently sewn to the cloth assembly 20 via a short strap 41.

It is envisioned that other styles and configurations of the present invention can be easily incorporated into the teachings of the present invention, and while only one particular configuration is shown and described that is for purposes of clarity and disclosure and not limitation.

The preferred embodiment of the present invention can be used by the common caregiver 100 in a simple and effortless manner with little or no training. After initial purchase or acquisition of the baby burping cloth 10, it would be installed as indicated in FIG. 1.

The method of installing and using the baby burping cloth 10 may be achieved by performing the following steps: procuring a model of the cloth assembly 20 having a desired size, external color/pattern, and a prosthetic breast 34 having a desired size; placing the shoulder section 28 of the cloth assembly 20 upon the right shoulder of the caregiver 100 (or flipping the cloth assembly 20 over to align the shoulder section 28 with a left shoulder of the caregiver 100); fastening the clip 40 to the front shoulder of a caregiver's blouse or shirt; installing the prosthetic breast 34 within the cloth assembly 20 by holding the prosthetic breast 34 in the caregiver's hand and inserting the prosthetic breast 34 through an access opening 30; positioning the prosthetic breast 34 as desired position; attaching the prosthetic breast 34 by pressing the breast fastening surface 38 of the prosthetic breast 34 against the front fastening surface 32*a* or against the rear fastening surface 32*b*, based upon the orientation of the cloth assembly 20; positioning an infant 105 on the baby burping cloth 10 such that the prosthetic breast 34 contacts the infant 105 in a desired manner; pulling up the leg section 24 around the leg of the infant 105, if desired; fastening the leg section 24 in place using the hook-and-loop fasteners 80; wrapping the first side section 26*a* and then the second side region 26*b* around the infant 105; securing the side sections 26*a*, 26*b* using the hook-and-loop fasteners 80; burping the infant 105 in a conventional manner; and, benefiting from improved burping propagation due to the pressure applied by the prosthetic breast 34 to the infant 105 while using the present invention 10.

Additionally, the baby burping cloth 10 may also be used for burping an infant 105 by removing the prosthetic breast 34 completely and allowing the cloth assembly 20 to act as a conventional protective cloth layer to be used during the burping process.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A baby burping cloth, comprising:

a cloth assembly having a front panel and a rear panel attached along their edges to define an inner space, said cloth assembly including a shoulder section, a leg section having leg openings, a first side section, and a second side section;

a prosthetic breast within said inner space;

a first access opening into said inner space;

a front fastening surface in said inner space and accessible by said first access opening;

a first fastener attached to said cloth assembly for holding said first side section and said second side section in an overlapping configuration; and, a strap for fastening said baby burping cloth to a user.

2. The baby burping cloth according to claim 1, wherein said prosthetic breast is accessible by said first access opening and is attachable to said front fastening surface.

3. The baby burping cloth according to claim 2, further including a rear fastening surface within said inner space and accessible by said first access opening.

4. The baby burping cloth according to claim 3, wherein said prosthetic breast is attachable to said rear fastening surface.

5. The baby burping cloth according to claim 4, further including a second access opening into said inner space, said second access opening providing access to said front fastening surface, to said rear fastening surface, and to said prosthetic breast.

6. The baby burping cloth according to claim 5, wherein said front panel and said rear panel are sewn together.

7. The baby burping cloth according to claim 6, wherein said front panel and said rear panel are substantially the same.

8. The baby burping cloth baby burping cloth according to claim 6, wherein said leg openings pass through both said front panel and said rear panel.

9. The baby burping cloth baby burping cloth according to claim 1, wherein said first fastener is a hook-and-loop fastener.

10. A baby burping cloth, comprising:

a cloth assembly having a front panel and a rear panel attached along their edges to define an inner space having a front fastening surface and a rear fastening surface, said cloth assembly including a shoulder section, a leg section having leg openings, a first side section, and a second side section;

a prosthetic breast having a surface configured to attach to either said front fastening surface or to said rear fastening surface;

a first access opening into said inner space and a second access opening into said inner space;

a plurality of fasteners attached to said cloth assembly for holding said first side section and said second side section in an overlapping configuration and for holding the bottom of said leg section in an upward folded configuration; and, a strap for fastening said baby burping cloth to a user.

11. The baby burping cloth according to claim 10, wherein said prosthetic breast is accessible by said first access opening and by said second access opening.

* * * * *